US008004400B2

(12) United States Patent
Tieman et al.

(10) Patent No.: US 8,004,400 B2
(45) Date of Patent: Aug. 23, 2011

(54) COMMUNICATION METHOD FOR LOCATING A PARKED VEHICLE

(75) Inventors: Craig A. Tieman, Westfield, IN (US); Tom Miklik, Kokomo, IN (US); Fiean Liem, El Paso, TX (US); Dale L. Partin, Ray, MI (US)

(73) Assignee: Delphi Technologies, Inc., Troy, MI (US)

( * ) Notice: Subject to any disclaimer, the term of this patent is extended or adjusted under 35 U.S.C. 154(b) by 337 days.

(21) Appl. No.: 12/290,969

(22) Filed: Nov. 5, 2008

(65) Prior Publication Data

US 2010/0109914 A1 May 6, 2010

(51) Int. Cl.
*G08B 1/08* (2006.01)

(52) U.S. Cl. ..... 340/539.13; 340/991; 340/988; 340/5.61

(58) Field of Classification Search ..... 340/539.13, 340/991, 988, 572.1, 989, 425.5, 426.26, 340/10.1, 825.36, 5.61
See application file for complete search history.

(56) References Cited

U.S. PATENT DOCUMENTS

| | | | | |
|---|---|---|---|---|
| 6,069,564 | A | 5/2000 | Hatano et al. | |
| 6,529,142 | B2 * | 3/2003 | Yeh et al. | 340/988 |
| 6,694,258 | B2 * | 2/2004 | Johnson et al. | 701/213 |
| 6,909,964 | B2 * | 6/2005 | Armstrong et al. | 701/207 |
| 7,148,802 | B2 * | 12/2006 | Abbruscato | 340/539.13 |
| 7,242,321 | B2 * | 7/2007 | New et al. | 340/988 |
| 7,369,061 | B1 * | 5/2008 | Sellers et al. | 340/932.2 |
| 7,663,508 | B2 * | 2/2010 | Teshima et al. | 340/988 |
| 7,688,226 | B2 * | 3/2010 | McCall | 340/991 |
| 2009/0098907 | A1 * | 4/2009 | Huntzicker et al. | 455/556.1 |
| 2010/0241347 | A1 * | 9/2010 | King et al. | 701/201 |

* cited by examiner

*Primary Examiner* — Toan N Pham
(74) *Attorney, Agent, or Firm* — Jimmy L. Funke

(57) ABSTRACT

A method of locating a parked vehicle that is equipped with a RKE system including a vehicle-installed RF communication module and a driver-borne wireless RF nomadic device such as a key fob involves installing a RFID tag in the nomadic device and a RFID interrogator in the vehicle. The driver depresses a button on the nomadic device to transmit a location request to the vehicle's communication module, and the RFID interrogator in turn emits a RF interrogation signal to identify the RFID tag and determine its location relative to the vehicle. The communication module then transmits a compass bearing to the nomadic device, and an indicator of the nomadic device is activated to provide the driver with a bearing for locating the vehicle.

8 Claims, 3 Drawing Sheets

COMMUNICATION METHOD FOR LOCATING A PARKED VEHICLE

TECHNICAL FIELD

The present invention relates to determining the location of a parked vehicle, and more particularly to a method of locating a parked vehicle using a radio frequency identification (RFID) tag.

BACKGROUND OF THE INVENTION

Many drivers that park their vehicles in large public parking lots have difficulty locating the vehicle upon returning to the parking lot. If a vehicle is equipped with a remote keyless entry (RKE) system, the driver can sometimes locate it by remotely activating a vehicle control function such as a horn chirp or panic alarm using the nomadic keyfob of the RKE system. However, such an approach is indirect at best, has a limited range, and can create a disturbance or attract unwanted attention. Accordingly, what is desired is a more direct and effective way for a driver to locate a parked vehicle.

SUMMARY OF THE INVENTION

The present invention provides an improved method of locating a parked vehicle that is equipped with a RKE system including a vehicle-installed radio frequency (RF) communication module and a driver-borne wireless RF nomadic device such as a key fob. An active or passive RFID tag is installed in the nomadic device, and the vehicle is additionally equipped with a RFID interrogator. The driver depresses a button on the nomadic device to transmit a location request to the vehicle's communication module, and the RFID interrogator in turn emits a RF interrogation signal to identify the RFID tag and determine its location relative to the vehicle. The RF communication module then transmits a compass bearing to the nomadic device, and an indicator or display of the nomadic device is activated to provide the driver with a directional indication for locating the vehicle. An internal electronic compass on the nomadic device is used to determine the direction.

DESCRIPTION OF THE PREFERRED EMBODIMENT

Figure 1:
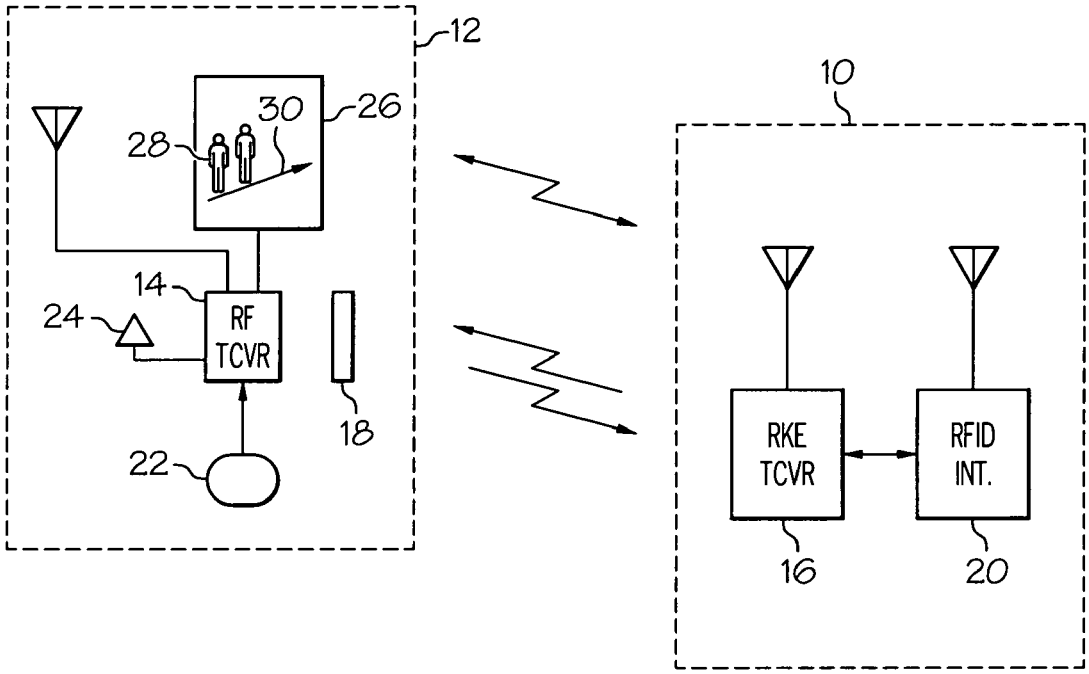
FIG. 1 is a system diagram including a vehicle equipped with a RF communication module and a RFID interrogator, and a wireless RF nomadic device with a RFID tag.

Referring to the system diagram of FIG. 1, the reference numeral 10 generally designates a vehicle, and the reference numeral 12 generally designates a nomadic device carried by a driver of the vehicle and incorporating a battery-powered RF transceiver 14. The vehicle 10 is equipped with an RF communication module 16, which together with the nomadic device 12, constitutes a remote keyless entry (RKE) system.

The RKE system can be used in a traditional manner to remotely perform functions such as door locking/unlocking, panic alarm activation/deactivation and engine turn on/turn off, and to remotely access vehicle status information. Additionally, the nomadic device 12 is equipped with an active or passive RFID tag 18, and the vehicle 10 is equipped with a RFID interrogator 20. When the RFID interrogator 20 is activated, it transmits a long-range omni-directional RF beacon signal or energy field. When the RFID tag 18 receives the RF beacon signal, it transmits a signal that, in turn, is received by the RFID interrogator 20. The RFID interrogator 20 includes two or more separate receiver channels responsive to the transmission from the RFID tag 18, and is able to determine not only the range to the RFID tag 18, but also the angle of arrival of its signal. A detailed description of such a directional RFID interrogator and RFID tag system is given, for example, in the U.S. Pat. No. 6,069,564, incorporated by reference herein.

The RF beacon signal can be emitted substantially simultaneously in all directions (approximately omni-directionally) and then the RFID interrogator 20 can detect which direction the return signal comes from. Alternatively, the RFID interrogator 20 may sequentially broadcast RF beacon signals in different directions, and after each broadcast, determine the strength of the return signal from the RFID tag 18. In this case, the direction from which the strongest return signal is obtained gives the approximate direction to the RFID tag 18 (relative to the vehicle). A weighted average of the return signals may be used to more precisely find the direction to the RFID tag 18. In either case, an electronic compass on the vehicle 10 then determines the vehicle's orientation relative to the earth's magnetic field in order to determine a compass bearing to the RFID tag 18.

As shown in FIG. 1, the nomadic device 12 also includes a locator button 22, an electronic compass 24 and a driver display 26. The driver display 26 is used to communicate vehicle status information to the driver, and also to give the driver a directional heading indication, as indicated for example by the pedestrian graphic 28 and arrow 30, when the driver depresses the locator button 22. The compass 24 is used to determine the orientation of the nomadic device 12 so that the arrow 30 may be controlled to point toward the vehicle 10 regardless of how the nomadic device 12 is oriented. Optionally, nomadic device 12 may additionally be equipped with an accelerometer that detects inclination (if any) of the nomadic device 12 relative to the horizontal ground plane for providing improved accuracy and appropriateness of the displayed directional heading.

Figure 2:
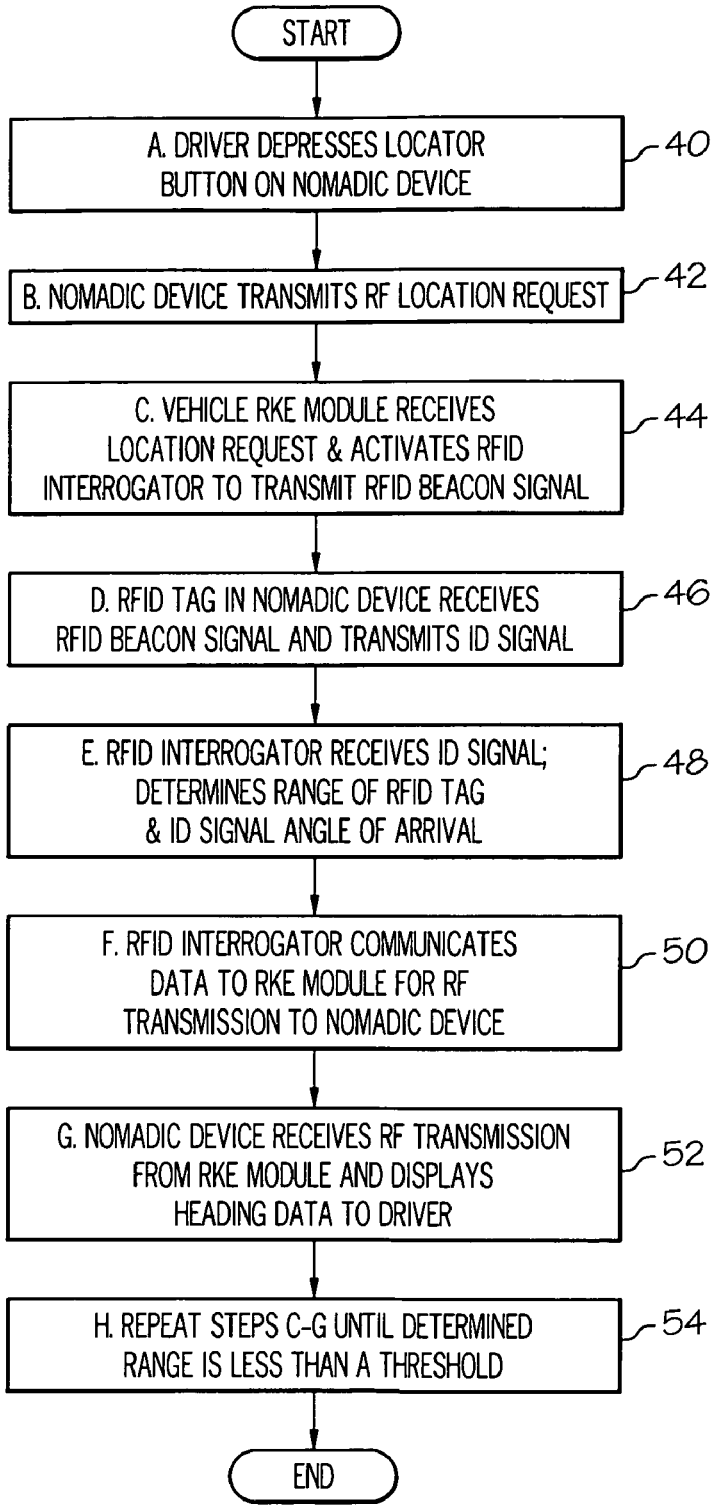
FIG. 2 is a process flow diagram illustrating a methodology for providing a directional indication for vehicle location with the nomadic device of FIG. 1 according to the present invention.

The process flow diagram of FIG. 2 depicts a method for driver location of the vehicle 10 using the components described above in respect to FIG. 1. As noted at block 40, the driver first depresses the locator button 22 of nomadic device 12. This activates the RF transceiver 14 to transmit a Location Request signal to the RF communication module 16, as indicated at block 42, and optionally also switches the RFID tag 18 from the default passive mode to an active (powered) mode for improved signal range. When the RF communication module 16 receives and verifies the Location Request signal, it activates RFID interrogator 20 to transmit an omni-directional RF beacon signal, as indicated at block 44. When the RFID tag 18 of nomadic device 12 is activated by the RF beacon signal, it emits a coded identification signal, as indicated at block 46. And once RFID interrogator 20 receives and decodes the emitted identification signal, it performs the required signal processing to determine range and angle of arrival, as indicated at block 48. This information is transferred from the RFID interrogator 20 to the RF communication module 16, which in turn, relays the information to the RF transceiver 14 of nomadic device 12, as indicated at block 50. Then as indicated at block 52, the nomadic device 12 activates its display 26 to indicate the direction to the vehicle 10 (and optionally its range) based on the transmitted heading information and the relative orientation of the nomadic device 12. As indicated at block 54, the steps designated by blocks 44-52 are periodically repeated to update the displayed heading until the determined range to the nomadic device 12 is less than a prescribed threshold.

Figure 3:
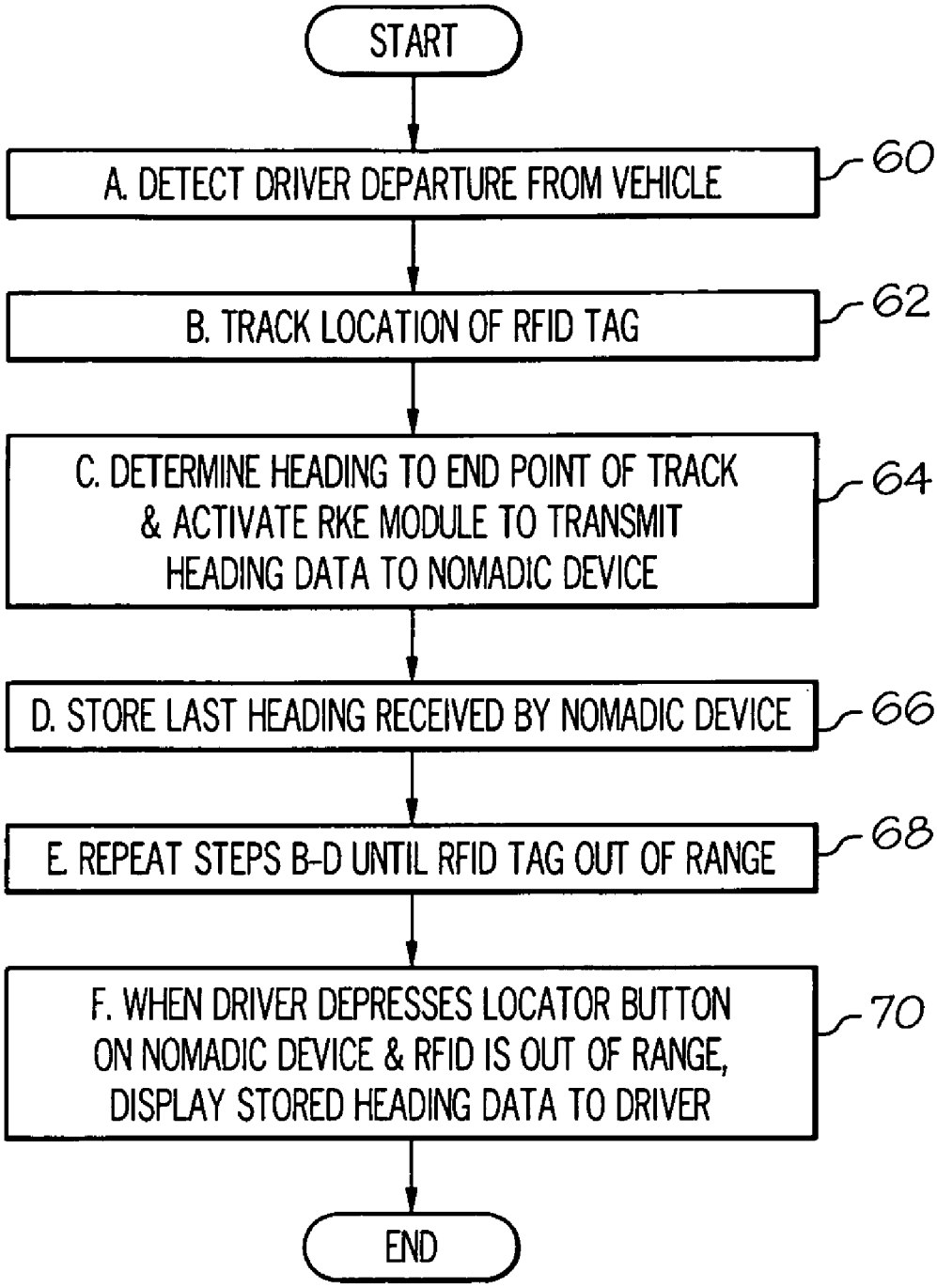
FIG. 3 is a process flow diagram illustrating an additional methodology for providing a temporary directional indication when the nomadic device of FIG. 1 is out of communication range with the vehicle.

The process flow diagram of FIG. 3 depicts an additional methodology for providing a temporary vehicle location heading to a driver that is out of range of the RFID interrogator 20. Referring to FIG. 3, the method involves detecting a departure of the driver from the vehicle 10, and then activating the RFID interrogator 20 to identify and track the location of the RFID tag 18 (and hence, the nomadic device 12), as indicated by the blocks 60-62. Detecting a departure from the vehicle can be accomplished by sensing engine turn-off, driver door opening and closing, driver seat becoming unoccupied, etc. The RFID interrogator 20 periodically determines a heading from vehicle 10 to the nomadic device 12 based on the current end point of the location tracking, and the communication module 16 is activated to transmit the heading to RF transceiver 14 of nomadic device 12, as indicated by block 64. The nomadic device 12 stores the received heading, as indicated at block 66, and the steps described by blocks 62-66 are periodically repeated until the nomadic device 12 is out of range for RF communication, as indicated at block 68. The last stored heading, then, represents the heading to the parked vehicle from the point where the nomadic device 12 was no longer in range for RF communication with the vehicle's communication module 16. If the RFID tag 18 remains in the range of the RFID interrogator 20 beyond a specified time interval such as five minutes, it is presumed that the driver is not leaving the vehicle, and tracking is suspended. When the driver returns to the parking lot and depresses the locator button 22 of nomadic device 12, the process described by the flow diagram of FIG. 2 will provide a heading to the driver if the nomadic device is within range for RF communication and the RFID tag 18 is within range of the RFID interrogator 20. However, if the nomadic device 12 is out of range, the heading last stored in nomadic device 12 is retrieved and used to provide a temporary heading indication to the driver, as indicated at block 70. And as the driver nears the vehicle 10 and the nomadic device 12 comes within range of the communication module 16 and RFID interrogator 20, a heading is provided according to the methodology of FIG. 2. Of course, the temporary heading is based on the assumption the driver re-enters the parking lot approximately where he or she left it, and the nomadic device 12 flags the temporary heading indication (by flashing, for example) to indicate that the displayed heading is based on the above-mentioned assumption. Nevertheless, this assumption is ordinarily borne out in practice, particularly if the driver knows that doing so will result in the most accurate temporary heading indication.

Advantageously, the disclosed RFID system may also be used to facilitate functions such as passive keyless entry and keyless starting. In the case of passive keyless entry, the vehicle 10 may include proximity or contact sensors to detect driver proximity or contact with a door handle, whereupon the RFID interrogator 20 transmits an RF beacon signal to the RFID tag 18. If the RFID return signal confirms the identify of the driver, and the distance to the RFID tag 18 is within a predetermined range (one meter, for example), the RFID interrogator 20 sends a door-unlock command to the vehicle's RKE module. The arrival direction of the RFID return signal can also be used to determine which door (or other panel) to unlock. In the case of keyless starting, the driver depresses a "start" button to start the engine, and the RFID interrogator 20 transmits an RF beacon signal to the RFID tag 18. If the RFID return signal reveals that the nomadic device 12 is in the vicinity of the driver seat and confirms the identify of the driver, keyless engine starting is authorized.

In summary, the method of the present invention adds useful functionality to a nomadic device commonly carried by most vehicle drivers, and cost-effectively provides the driver with an accurate heading indication when requested. While the present invention has been described with respect to the illustrated embodiment, it is recognized that numerous modifications and variations in addition to those mentioned herein will occur to those skilled in the art. For example, the driver display 26 of nomadic device 12 can be simpler than shown (such as a flashing lamp), some of the processing steps can be carried out by the nomadic device 12, and so on. Accordingly, it is intended that the invention not be limited to the disclosed embodiment, but that it have the full scope permitted by the language of the following claims.

The invention claimed is:

1. A method for locating a vehicle from a remote nomadic device, comprising the steps of:

providing a RF communication module and a RFID interrogator in the vehicle;

providing a RF transceiver, a RFID tag and an indicator in the nomadic device, said RF transceiver, RFID tag, and indicator powered by a nomadic device battery;

activating the RF transceiver of the nomadic device to transmit a location request to said communication module;

in response to receipt of the location request by the communication module, activating the RFID interrogator to interrogate said RFID tag and determine a direction and a range of said RFID tag relative to said vehicle;

activating the communication module to transmit a bearing to the RF transceiver of the nomadic device based on the determined relative direction and range of said RFID tag; and activating the indicator of said nomadic device to indicate said bearing.

2. The method of claim 1, including the steps of:

providing an electronic compass in the nomadic device;

determining a heading to the vehicle relative to the nomadic device using the transmitted bearing and an output of the electronic compass; and activating the indicator of said nomadic device to display the determined heading.

3. The method of claim 1, including the steps of:

determining a range from the vehicle to the nomadic device;

activating the communication module to transmit the determined range to the RF transceiver of the nomadic device; and displaying the determined range on the indicator of the nomadic device.

4. The method of claim 1, including the steps of:

activating the RFID interrogator to interrogate said RFID tag and determine a range of said RFID tag relative to said vehicle in response to a detected proximity of the driver to the vehicle; and activating a vehicle unlock function if the determined range is within a prescribed range.

5. The method of claim 1, including the steps of:

activating the RFID interrogator to interrogate said RFID tag and determine a range of said RFID tag relative to said RFID interrogator in response to occupant actuation of an engine start command; and authorizing engine starting if the determined range is within a prescribed range.

6. A method for locating a vehicle from a remote nomadic device, comprising the steps of:

providing a RF communication module and a RFID interrogator in the vehicle;

providing a RF transceiver, a RFID tag and an indicator in the nomadic device;

detecting that the nomadic device has left the vehicle;

tracking the nomadic device to obtain bearing information, and periodically transmitting the bearing information to the RF transceiver of the nomadic device;

storing the transmitted bearing information in the nomadic device;

activating the RF transceiver of the nomadic device to transmit a location request to said communication module;

in response to receipt of the location request by the communication module, activating the RFID interrogator to interrogate said RFID tag and determine a direction and a range of said RFID tag relative to said vehicle;

retrieving the stored bearing information for display on the indicator of the nomadic device in response to subsequent driver activation of the nomadic device if the RFID tag is out of range of the RFID interrogator;

activating the communication module to transmit a bearing to the RF receiver of the nomadic device based on the stored bearing; and activating the indicator of said nomadic device to indicate said bearing.

7. The method of claim 4, including the steps of:

providing an electronic compass in the nomadic device;

determining a heading to the vehicle relative to the nomadic device using the transmitted bearing and an output of the electronic compass; and activating the indicator of said nomadic device to display the determined heading.

8. The method of claim 4, including the steps of:

activating the RFID interrogator to interrogate said RFID tag and determine a range of said RFID tag relative to said RFID interrogator;

activating the communication module to transmit the determined range to the RF transceiver of the nomadic device; and displaying the determined range on the indicator of the nomadic device.

* * * * *